United States Patent [19]

Laurus et al.

[11] Patent Number: 4,729,201

[45] Date of Patent: Mar. 8, 1988

[54] DOUBLE TOP CHORD

[75] Inventors: Felix F. Laurus, Nepean; Ernest O. Butts, Ottawa, both of Canada

[73] Assignee: Hambro Structural Systems Ltd., Ottawa, Canada

[21] Appl. No.: 4,202

[22] Filed: Jan. 5, 1987

Related U.S. Application Data

[63] Continuation of Ser. No. 522,734, Aug. 12, 1983, abandoned, which is a continuation-in-part of Ser. No. 458,365, Jan. 17, 1983, abandoned.

[30] Foreign Application Priority Data

Aug. 13, 1982 [AU] Australia ..... PF5379
Sep. 24, 1982 [AU] Australia ..... PF6050

[51] Int. Cl.[4] ..... E04B 5/18
[52] U.S. Cl. ..... 52/334; 52/340
[58] Field of Search ..... 52/321, 340, 319, 320, 52/729, 730, 731, 734, 693, 414, 333, 334, 335, 336

[56] References Cited

U.S. PATENT DOCUMENTS

| | | | |
|---|---|---|---|
| 1,789,827 | 1/1931 | McKay | 52/354 |
| 1,791,680 | 2/1931 | Miller | 52/690 |
| 1,873,762 | 8/1932 | Hauf | 52/690 |
| 1,879,295 | 9/1932 | Kahn | 52/376 |
| 1,885,883 | 11/1932 | Young | 52/335 |
| 1,968,045 | 7/1934 | Kotrbaty | 52/370 |
| 1,993,791 | 1/1931 | Kotrbaty . | |
| 2,016,616 | 10/1935 | Schaub | 52/334 |
| 2,097,722 | 11/1937 | Coddington | 52/376 |
| 2,143,887 | 4/1935 | Kotrbaty . | |
| 2,169,253 | 8/1939 | Kotrbaty | 52/693 |
| 2,479,475 | 8/1949 | Cueni | 52/334 |
| 2,574,667 | 11/1951 | Shuman | 52/334 |
| 2,860,743 | 11/1958 | Cliff | 52/693 |
| 2,996,160 | 8/1961 | Voight | 52/376 |
| 3,093,932 | 6/1963 | Dreier . | |
| 3,596,421 | 8/1971 | Miller | 52/333 |
| 3,608,267 | 9/1971 | Curran | 52/332 |
| 3,683,580 | 8/1972 | McManus | 52/334 |
| 3,686,819 | 8/1972 | Atkinson . | |
| 3,819,143 | 6/1974 | Butts et al. | 249/33 |
| 3,845,594 | 1/1974 | Butts et al. | 52/98 |
| 3,913,296 | 10/1975 | Butts | 52/694 |
| 3,945,168 | 3/1976 | Butts et al. | 52/720 |
| 3,968,616 | 7/1976 | Gostling | 52/645 |
| 4,015,396 | 4/1977 | Butts et al. | 52/690 |
| 4,056,908 | 11/1977 | McManus | 52/334 |
| 4,151,694 | 5/1979 | Sriberg et al. | 52/335 |
| 4,259,822 | 4/1981 | McManus | 52/334 |

FOREIGN PATENT DOCUMENTS

| | | | |
|---|---|---|---|
| 124770 | 6/1947 | Australia . | |
| 404793 | 1/1909 | France | 52/354 |
| 484546 | 1/1917 | France | 52/335 |
| 2274750 | 9/1976 | France . | |
| 7803019 | 10/1979 | Sweden | 52/729 |
| 1427008 | 3/1976 | United Kingdom . | |

*Primary Examiner*—John E. Murtagh
*Attorney, Agent, or Firm*—Cushman, Darby & Cushman

[57] ABSTRACT

A steel joist is disclosed consisting of a web, a bottom chord and a double top chord construction consisting of two elongated substantially identical portions each being of S cross-section and being connected to or integral with the web.

15 Claims, 16 Drawing Figures

DOUBLE TOP CHORD

Figure 1:
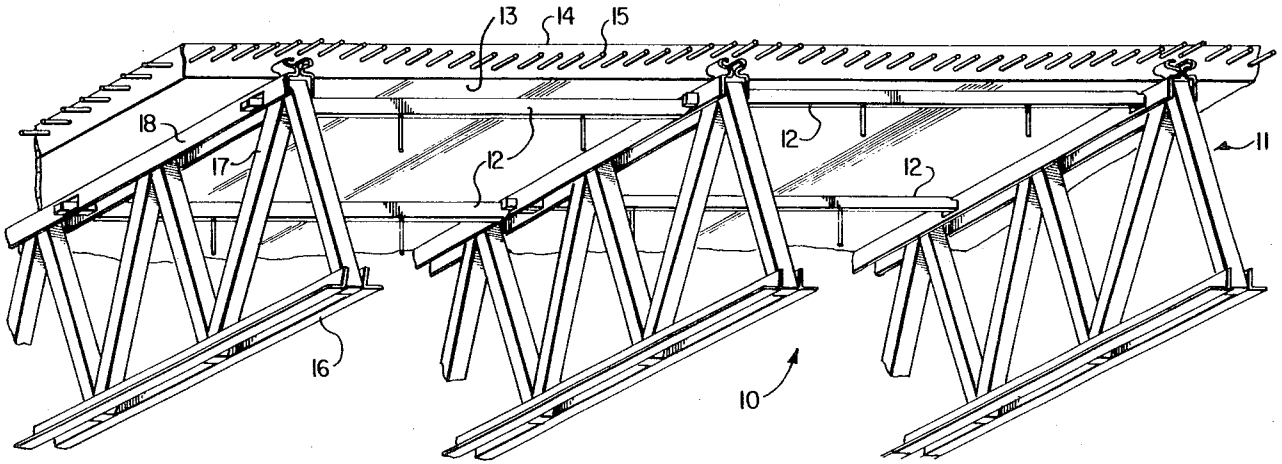

This is a continuation of application Ser. No. 522,734, filed Aug. 12, 1983, which was abandoned upon the filing hereof and which was a continuation-in-part of Ser. No. 458,365 filed Jan. 17, 1983, now abandoned.

The present invention relates to improvements in steel joists and composite steel and concrete construction systems. The present invention constitutes an improvement upon the Butts et al prior invention patented in U.S. Pat. No. 3,845,594 on Nov. 5, 1974. Other related Butts et al patents are U.S. Pat. Nos. 3,819,143, 3,913,296, 3,978,868 and 4,015,396.

The present invention discloses an improvement on the aforesaid patented structures in which a composite steel and concrete structure comprises a horizontal concrete slab containing reinforcing mesh and surmounting and partially embedding a plurality of steel joists. Each joist has a top chord and a bottom chord which are connected by a web. The improved joist of the present invention includes a pair of symmetrical oppositely positioned S shaped flanges, extending the lenth of the joist and connected to the web. In such a joist, the web may be composite of a plurality of structural shapes connected together to form an open truss structure between the top and bottom chords.

In an alternative form of the invention, the web may be constructed of solid sheet material, either integral with or separate from the top and bottom chords of the steel joist.

The present invention constitutes a significant advancement and improvement on the prior patents as aforesaid, and in particular, provides a joist possessed of greatly superior properties in comparison with prior art joists. Among such properties is a significant improvement in lateral stiffness which greatly improves the strength of the composite structure during the construction stages and permits safer construction procedures particularly where long spans are involved. Thus, applicants are able to erect long span constructions in excess of the present limit of 13 meters, and may extend these spans to 20 or 25 meters without difficulty. By utilizing angles, channels or tubes for web members, it is possible to increase the radius of gyration of these sections over a solid round section and thus higher unit stresses may be tolerated in the web members and a saving in steel weight results in a more efficient joist construction.

The joist of the present invention may be constructed from high strength steel, and incorporated into a structure which possesses a two hour fire classification rating. This is a matter of great significance in the advancement of composite construction, as safety considerations are of ultimate importance in any building intended for use for residential or office purposes.

The joist of the present invention is symmetrical about the vertical axis of the joist, which symmetry provides structural advantages during the non-composite or installation stage, where the unpropped joist is required to carry the weight of wet concrete, form work, its own weight and other construction live loads that may be imposed, such as the weight of workmen, or possible excess concrete due to localized thickness or impact of concrete pouring buckets. The double top chord profile provides a greater cross-sectional area in this critical component of a long span joist, which improves its lateral slenderness properties thereby making it stiffer. This increased stiffness increases the capacity of the joist to resist compressive stresses. Correspondingly this reduces the degree of lateral restraint that need be provided to the top chord or top flange during the construction stage, which lateral restraint is normally provided by a combination of roll bars and plywood form work securely attached to lateral supporting wall beams and the like. There are clear economic advantages to this improved performance of the joist, resulting in cost savings during the erection of composite steel and concrete floor systems, which savings may be translated into lower cost per square foot of floor space which may be passed on to owners and occupants in the form of reduced capital costs, reduced rents and the like. Also, the joist of the present invention being symmetrical provides significant improvements in the fabrication stage, since distortion caused by heating during welding procedures is minimized.

Sweep is a phenomenon encountered when constructing a welded joint, where the welds all occur on one side of the web. This creates a stress in the joist which tends to cause a curvature to occur in the completed joist. This curvature has been overcome in present practice by pre-curving the top chord in a direction opposite to the direction in which the sweep will occur, so that the completed joist when welded together returns to a substantially straight longitudinal configuration. With the symmetrical properties of the joist of the present invention, the entire problem of sweep due to welding stresses is avoided, and a straight joist is obtained without the necessity for complicated precompensation techniques during fabrication.

All of the above advantages mean that the joist of the present invention when compared with applicant's prior structure is even more stable laterally and torsionally during the non-composite stage, and accordingly longer spans may be more safely constructed than were possible in accordance with the prior art.

Figure 2:
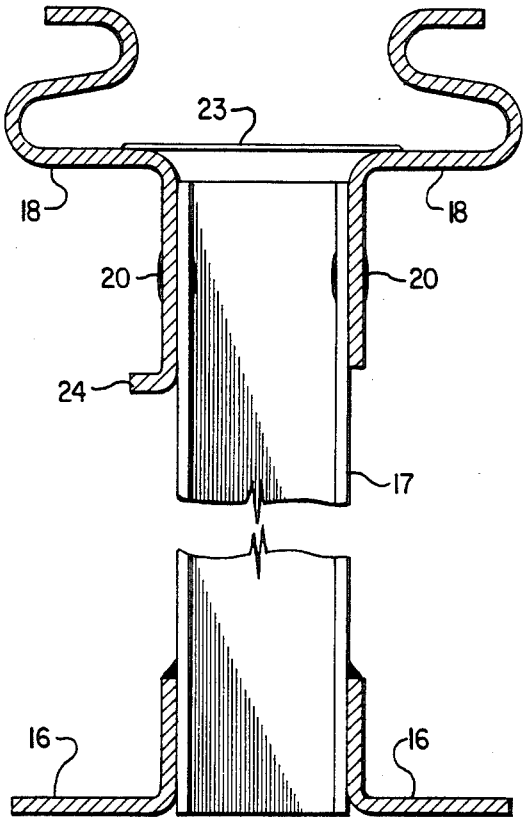
Figure 2B:
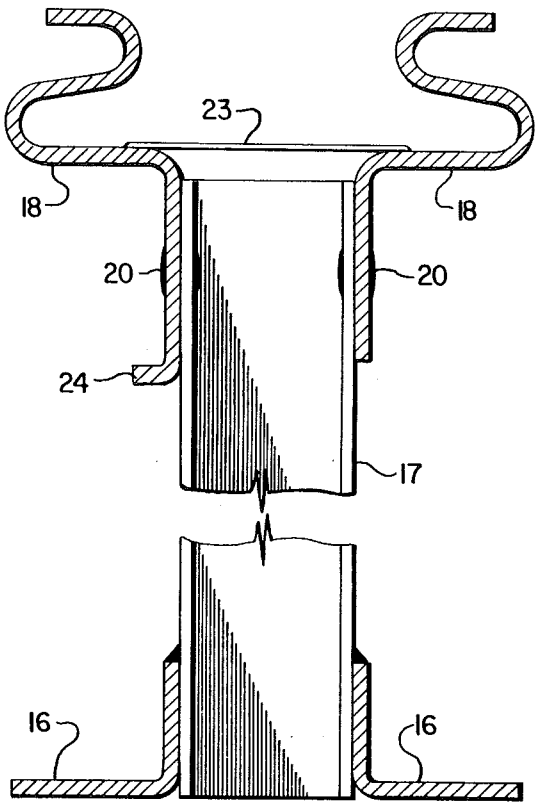
Figure 2A:
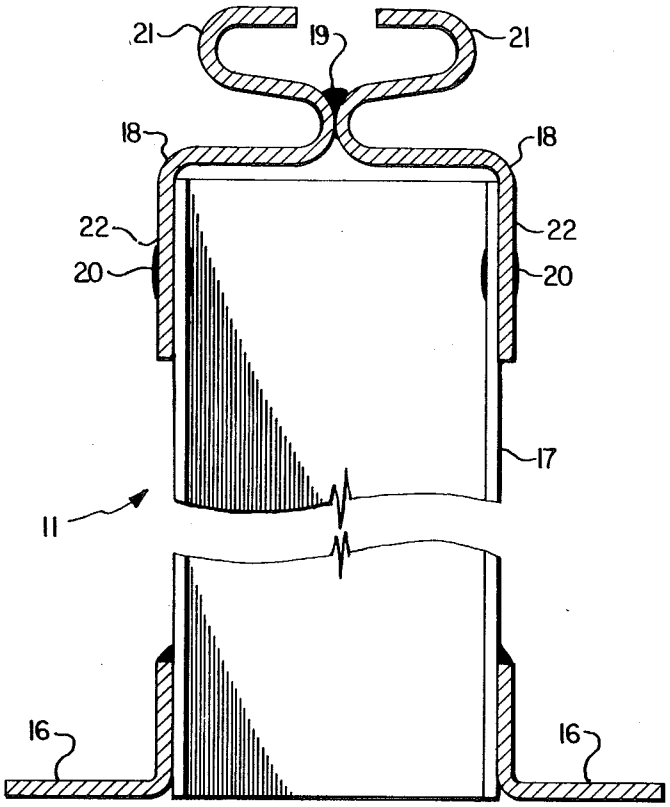
Figure 3A:
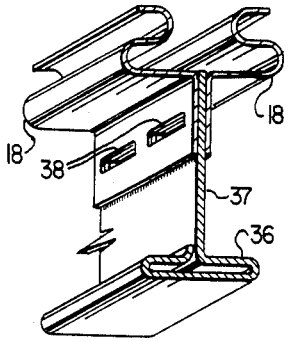
Figure 3B:
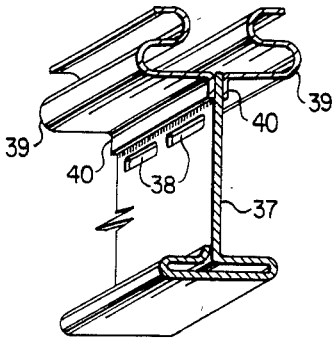
Figure 3C:
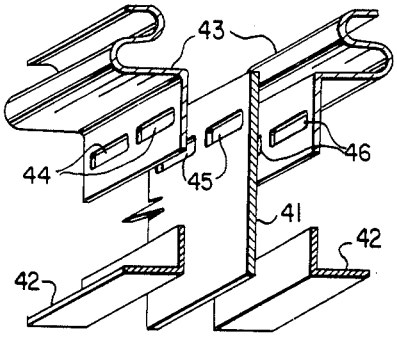
Figure 3D:
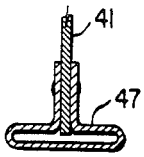
Figure 4A:
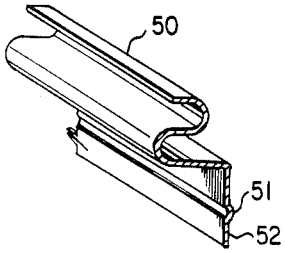
Figure 4B:
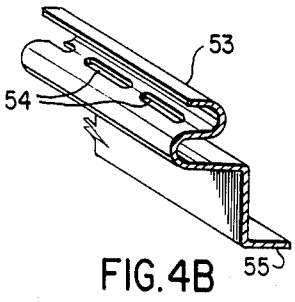
Figure 4C:
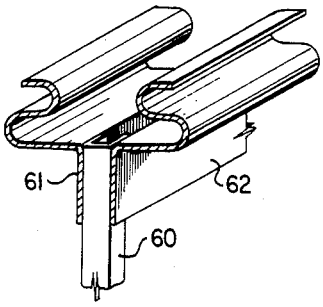
Figure 4D:
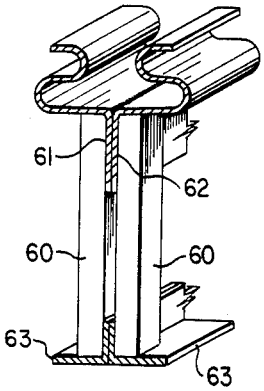
Figure 4E:
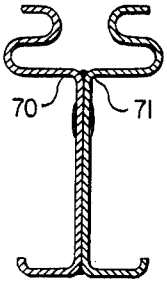
Figure 4F:
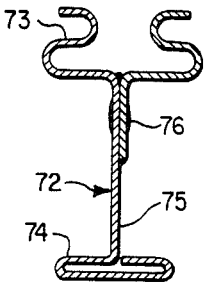
Figure 5:
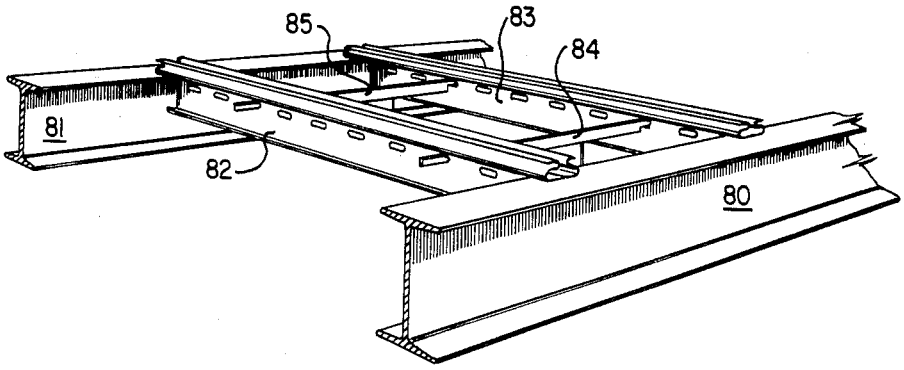
Figure 6:
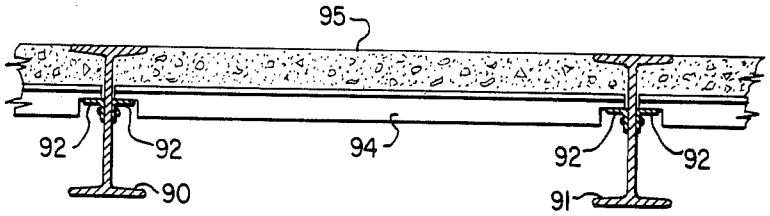

In the accompanying drawings:

FIG. 1 is a perspective view from below of a composite construction utilizing joists of the present invention, FIG. 2 is a vertical section through joists constructed in accordance with the present invention illustrating an arrangement of the top chord members, FIGS. 3A, 3B, 3C and 3D illustrate features of joist in which the web is a continuous sheet, FIGS. 4A, 4B, 4C, 4D, 4E and 4F illustrate further details of top chord to web connections, and joist fabrication techniques, FIG. 5 is a perspective of an in-fill framing system using joists the cross-section of which is shown if FIG. 4E, and FIG. 6 is a section through a composite steel and concrete construction in accordance with another aspect of the present invention.

With reference to FIG. 1 of the attached drawings, there is shown a composite steel and concrete floor system 10 consisting of a plurality of open web joists 11 connected together with roll or spanner bars 12, which serve to support form work 13, on which a concrete slab 14 is poured, which slab includes reinforcing mesh 15. Each of the open web joists 11 consists of a bottom chord 16, which as shown in FIG. 1 may consist of a pair of right angled members 16, a series of web members 17 and dual top chords 18. The top chords are provided with appropriate slots through which the roll or spanner bars may be inserted to support form work, the roll or spanner bars being either permanent roll bars intended to remain in the structure when complete, or may be removable roll bars as taught for example in the prior U.S. Pat. No. 3,945,168.

Referring to FIG. 2 there is shown in vertical section, an open web joist 11 having a pair of bottom angles 16, forming the bottom chord of the joist, a pair of top chord members 18, and a web which may be for example formed of hollow rectangular cross-section tubular members, or of channel members 17. As illustrated in FIG. 2 the two top chord members are welded to the web members 17 by welds 20. The welds 20 as illustrated may be spot or seam welds, and are positioned to provide the maximum strength, and to enable a welding electrode to be inserted inside the member 17, to make a satisfactory weld. Each top chord member 18 is formed of an identical cross-section profile shape having an upper S portion 21 and a downwardly depending leg 22. As in the aforesaid prior patents, it is intended that the S shaped portions 21 be embedded in the concrete slab of the composite construction, the S shapes providing a superior shear connection between the concrete slab and the joists to provide a true composite action between the joists and the slab. It should be noted that the two top chord members are positioned in mirror image relationship to one another, thus providing a perfectly symmetrical configuration of joist about a vertical axis. The advantages of such symmetry are detailed hereinbefore.

An additional filler plate 23 is secured between the top chord members 18, and serves to seal the space between the two top chord members to prevent the loss of concrete through the open web of the joist, during construction.

FIG. 2 also illustrates an optional form of top chord member 18, which may be provided with an optional lip 24, which is useful for increasing the compressive strength of the joist in the non-composite mode, that is before the top chord has been embedded in concrete.

FIG. 3A illustrates in perspective an alternative form of joist in accordance with the invention in which the web and bottom chord are rolled from a single strip of steel. The web 37 of FIG. 3A is formed unitarily with the bottom chord 36, for example by the cold rolling of a suitable strip of sheet steel. As before, top chord members 18 are connected to the web 37 by welding, and opening 38 in the top chord and the web may be formed either before or after welding by a suitable punching operation. It will be appreciated that if the slots 38 are formed before the top chord members 18 are welded to the web 37, it will be necessary to provide means for aligning the slots 38 which extend entirely through both top chord members and the web 37 prior to welding. This alignment may create problems in fabrication in certain circumstances, and accordingly FIG. 3B illustrates an alternative to the structure illustrated in FIG. 3A in which the top chord members 39 are provided with only a very short downwardly depending leg 40 on the cross-sectional shape which leg is, as before, welded to the web 37. In this case, the web may readily be punched for the openings 38 prior to affixing the top chord members 39, and there is no necessity to align openings in the top chord members with corresponding openings in the web.

FIG. 3C illustrates in exploded perspective an alternative form of joist construction in accordance with the invention. In FIG. 3C the joist is formed of a strip or plate 41, angles 42 as bottom chords, and top chord members 43. The joist of FIG. 3C is fabricated by welding, and appropriate slots are formed in the top chord members 43 and in the web 41 prior to or after welding, with the necessary alignment being made so that the openings 44, 45 and 46 in the top chord members 43 and the web 41 would be appropriately aligned prior to running the welds.

FIG. 3D illustrates an alternative form of bottom chord 47, which can be used in place of the angles 42 of FIG. 3C. In this case a cold rolled steel bottom chord shape as shown in FIG. 3D would be attached to the web 41 as by welding.

FIG. 4A illustrates a form of top chord member 50 provided with a longitudinal rib 51 on the vertical leg 52 of the top chord section, which rib 51 would assist in electric resistance welding of the top chord member 50 to an appropriate web structure.

FIG. 4B illustrates an alternative form of top chord member 53 provided with a plurality of slots 54 in the sloping face of the top chord section to enhance the shear connection between the top chord and the concrete slab by permitting concrete to fill the slots 54 when the slab is being poured.

The top chord member 53 is also provided with a right angle flange 55 which may be used to support appropriate form-work, as an alternative, or ancillary to the use of conventional spanner or roll bars.

FIGS. 4C and 4D are perspective views illustrating the use of channel shapes as web members 60, which web members may be positioned centrally of the joist as in FIG. 4D, wherein the channel member 60 is positioned between the vertical legs 61 and 62 of the open web joist. In FIG. 4D where heavier construction loads are to be encountered, the vertical legs 61 and 62 of the top chord members are positioned tightly together, and channel web members 60 are positioned on either side of the vertical legs 61 and 62. Similarly, bottom chord members 63 shown in FIG. 4D as angle members may be positioned between the web members 60.

A further and highly desirable fabrication practice is to use channels for all compression members of the truss or open web joist, which are positioned inside or between the top chord members, and to use angles for tension members, which are positioned outside the top chord flanges.

FIGS. 4E and 4F illustrate two additional fabrication techniques. In FIG. 4E two identically shaped members 70 and 71 are welded back-to-back to provide a complete joist. Each member 70 and 71 is one half of the completed joist, the joint between the two members coinciding with the vertical axis of the completed joist. In FIG. 4F a first member 72 includes an S shaped top chord 73, a bottom chord portion 74, and a web 75. A second top chord portion 76 is welded to the web 75 to form the completed double top chord joist.

The fabrication technique illustrated in FIG. 4E provides a particularly advantageous technique in practicing the present invention. The symmetrical sections may be rolled, welded and punched to provide an economical and versatile joist for use in composite construction.

When fabricated as a shallow depth joist an efficient infill technique for steel beam structures is obtained. If a deeper joist is formed, an efficient regular span joist is obtained.

In to FIG. 5, there is shown a portion of a building floor system, including steel beams 80 and 81 supporting a pair of double top chord joists 82 and 83. Spanner bars 84 and 85 as taught in prior U.S. Pat. No. 3,845,594 connect the joists 82 and 83 and would support suitable sheeting (not shown) on which a concrete deck slab may be poured. Thus a smooth concrete slab may be poured, forming the floor of a building with a steel beam subframe.

In FIG. 6, a pair of steel beams 90 and 91 support ledger angles 92 on which a joist 94 is shown, embedded in and supporting a concrete slab 95. By the use of the ledger angles 92, a thickened slab may be obtained compared to the slab of FIG. 5, which may for example be used for an in-floor electrical distribution system (not shown).

Thus summarizing, the present application discloses an improved composite steel and concrete floor system, utilizing a novel form of joist having a pair of symmetrically opposite top chord members connected to a suitable web which in turn is connected to a suitable bottom chord structure. The applicant's top chord now consists of two S shaped members which may be identical to those taught in the aforesaid prior patents with the exception that the downward vertical leg may be modified in that it may be lengthened to provide the required additional welding surface for web connections. The lip in the present top chord construction may be either deleted or rolled in the opposite direction if necessary so as not to interfere with web members which are placed between or outside the top chord elements.

In the alternative, some web members may be located between the top chord elements and some outside the top chord elements. This option has definite advantages so far as welded connections are concerned in order to more easily align the web and chord members. The top chord member of the present invention is stronger than the prior top chord since the joist is symmetrical about its vertical axis. The downstanding legs of the top chord elements may of course be extended to increase welding surface area as required.

Insofar as slots are concerned, which are provided so that roll or spanner bars may be inserted therein to support form work, the function of these slots is unchanged from the teachings of prior patents. However the long ends of the roll bars of the prior art should be cut back so that they do not foul the opposite top chord element when being inserted during erection of a composite floor system. Alternatively further saw cuts may be made in the roll bar to accommodate the vertical flanges of the double top chord structure.

The web system of the present invention may be constructed of individual members which can be any shape conventionally used for such members. Commonly angles, flats, channels and rectangular sections may be used. The bottom chord of the joist may be of any conventional shape although generally a pair of angles is the most commonly encountered configuration.

The cover or fillet plate used to fill the top of the joist between the top chord members may be made of very light gauge material and its purpose is simply to prevent concrete from spilling through between the top chord elements. The uppermost portion of the individual web members is positioned so that it does not protrude above this cover plate. It would be logical to make the cover plate of light gauge steel and simply tack weld it into place. It would be considered a non-structural element and thus not included in the design calculations for the joist. Alternatively, however, a heavier cover plate could be utilized and welded into position to provide a more positive lateral connection between the top chord elements than that which would normally occur as a result of the top chord to web member welded connections. This heavier cover plate might then be included in the design calculations for the load bearing strength of the joist.

In general, the advantage of the applicant's improved joist structure is a great increase in lateral stability as result of the double top chord elements which are connected together by either web connections or a heavier gauge filler plate. The increased lateral stability or rigidity reduces the slenderness ratio of the top chord element and provides additional compression capacity during the non-composite structural stage of construction. Furthermore, the addition of a second top chord element provides increased cross-section area further enhancing the compression capacity of the joist. Thirdly the configuration now allows individual web members to be utilized more readily and provides for a more efficient web system which is lighter in weight especially in the longer spans of 35 feet and over, enabling the double top chord joist of the present application to be utilized in spans of 60 feet or more.

We claim:

1. In a composite action steel and concrete floor system wherein a plurality of steel joists span horizontally and in spaced parallel relationship between spaced support members, each said steel joist including a top chord, a bottom chord and an intermediate web vertically extending between said top and bottom chords, composite action being achieved by complete embedment of each top chord in said cured concrete, and in which said joists are subject to construction loads during a non-composite state of construction of said floor system due to their own weight, construction live loads and wet concrete, the improvement wherein each top chord of each joist comprises a pair of identical, longitudinally continuous, symmetrical, oppositely-positioned S shaped members extending in a parallel relationship for the length of the respective joist, said S shaped members being in mirror relation to one another with the right-hand one appearing in cross section in a regular upright S form and the left-hand one in reverse S Form and being transversely spaced apart symmetrically relative to said web providing a joist having symmetry about a vertical axis passing through said web, whereby the ability of said joists to withstand said construction loads during said non-composite steps is substantially increased.

2. A structure as claimed in claim 1, wherein each of said S shaped members has a downwardly depending leg and is connected to said web by welding said leg and said web together.

3. A structure as in claim 2, said legs of said top chord members being provided with a plurality of longitudinally spaced openings therein for receiving the ends of spanner bars for holding said joists in said spaced parallel relationships.

4. A structure as claimed in claim 1 wherein said web comprises a flat cold rolled steel sheet or plate.

5. A structure as claimed in claim 1 wherein said bottom chord comprises a pair of angle members connected to said web by welding.

6. A structure as claimed in claim 1 wherein said bottom chord comprises a pair of angle members connected to said web by welding.

7. A structure as claimed in claim 6 wherein said angle members are connected to said web by welded connections.

8. A structure as claimed in claim 1 wherein said bottom chord is integral with and rolled from a single piece of steel together with said web.

9. A structure in accordance with claim 1 wherein openings are provided in said web to receive said spanner bars to support concrete form work during erection of said composite steel and concrete structure.

10. A structure as claimed in claim 1 wherein said joist is formed of two identical cross-section members joined at said vertical axis, said web being of double thickness, the axis of symmetry passing through the centre of said web.

11. A structure as claimed in claim 1 wherein said joists are supported by steel beams and together with said slab form in an in-fill panel.

12. A structure as claimed in claim 11 wherein said beams are provided with ledgers fixed to the webs thereof whereby a thickened slab is obtained.

13. A structure as in claim 1 wherein each said joist is formed of two identically-shaped joist members joined back-to-back, each joist member containing one-half of the said top chord, web and bottom chord and constructed of rolled sections of sheet steel.

14. A structure as in claim 1 wherein each S shaped member has top and bottom flanges and an intermediate member connecting opposite ends of said top and bottom flanges, the resulting free ends of said top and bottom flanges being pointed in opposite directions for allowing said concrete to flow between and totally fill the space between said S Shaped members of each joist when said slab is poured.

15. A structure as in claim 1 including supplementary means including discrete apertures in said S shaped members along their length for enhancing the shear connection between each of said top chords and said slab.

* * * * *